US005980298A

United States Patent [19]

Johnson

[11] Patent Number: 5,980,298

[45] Date of Patent: Nov. 9, 1999

[54] STRAIN RELIEF FOR CABLE CONNECTOR

[75] Inventor: Chris S Johnson, Austin, Tex.

[73] Assignee: National Instruments Corporation, Austin, Tex.

[21] Appl. No.: 08/935,641

[22] Filed: Sep. 23, 1997

[51] Int. Cl.[6] ..... H01R 13/627

[52] U.S. Cl. ..... 439/359; 439/372; 439/472

[58] Field of Search ..... 439/373, 449, 439/470, 472

[56] References Cited

U.S. PATENT DOCUMENTS

| | | | |
|---|---|---|---|
| 3,864,011 | 2/1975 | Huber | 439/472 |
| 4,130,334 | 12/1978 | Anderson | 439/472 |
| 4,352,531 | 10/1982 | Gutter | 439/472 |
| 4,358,177 | 11/1982 | Badolata | 439/472 |
| 4,448,474 | 5/1984 | Melnychenko | 439/472 |

*Primary Examiner*—Hien Vu

*Attorney, Agent, or Firm*—Conley, Rose & Tayon; Jeffrey C. Hood

[57] ABSTRACT

A strain relief device for coupling of a cable connector to a terminal of an electrical device. The strain relief device includes an elongated base member having a flat surface extending between first and second end portions. A fastener is fixedly connected to the flat surface at the first end portion, for releasably fastening the base to an external surface of a housing to the electrical device. A clamping device extends perpendicularly from the base at the second end portion. The clamping device defines an adjustable slot configured to receive the cable connector. Moreover, the slot is moveable to several elevations with respect to the base. When the base is fastened to the external surface of the electrical device, the slot can be moved to align a cable connector received therein with a terminal of the electrical device.

22 Claims, 4 Drawing Sheets

STRAIN RELIEF FOR CABLE CONNECTOR

BACKGROUND OF THE INVENTION

1. Field of the Invention

The present invention relates generally to the art of electrical coupling and more particularly to devices which provide strain relief for electrical connectors.

2. Description of the Relevant Art

Electrical devices, such as laptop computers, often contain externally accessible terminals configured to transmit or receive data to or from external devices via data cables. Data terminals and cables are often electrically connected together for data transmission via cable connectors interfacing therebetween.

Cable connectors are well-known in the art and are available in a variety of sizes and shapes. In addition to serving as an interface between terminals and data transmission cables, cable connectors serve to secure cable coupling. To this end, some cable connectors are provided with coupling hardware which releasably engages mating structure provided at the data terminal. Typically, the coupling hardware includes clips, screws, or other types of fasteners. Once cable connectors are coupled or "plugged" into data terminals, the coupling hardware generally guards against decoupling therefrom. However, certain types of connectors, e.g., PC cards, do not include coupling hardware.

Often times, electrical devices such as laptop computers are used in field experiments for acquiring data generated by external devices, also in the field. The generated data is often transmitted to terminals of the data acquisition device via PC cards. For example the auto industry uses laptop computers to collect data generated by sensing devices which sense operational parameters of an internal combustion engine within a moving automobile. Mechanical forces such as vibrational effects associated with the moving automobile, can cause the PC card to decouple from a data input terminal. Obviously once decoupled, the laptop computer acting as a data acquisition device, can no longer collect data.

Thus, the prior art technique of using screws, clips, or other fasteners to secure cable connecters, often does not provide enough coupling effect to withstand the forces associated with field data collection. Furthermore, many prior art connectors are provided with no coupling hardware to secure engagement with a data input terminal.

SUMMARY OF THE INVENTION

The present invention addresses the problems set forth above and others and provides a strain relief device for securing a cable connector. The strain relief device is particularly useful in connection with cable connectors with weak or no coupling hardware. Moreover, the present invention is adjustable to accommodate for cable connectors of different size and shapes and for data input terminals which vary in position within an electrical device.

The present invention includes, in one embodiment, an elongated base member having a flat surface extending between first and second end portions. Connected to the base member at the first end portion is a fastener for releasably fastening the base to an external surface of a housing of the electrical device. A clamping device extends from the base member at the second end portion and provides a slot for receiving and rigidly securing a cable connector. The slot is size adjustable to accommodate for cable connectors of different sizes and shapes. Moreover, the slot is moveable relative to the base so that when the base is fastened to the external surface of the electrical device housing, the slot may accommodate differences in terminal positions relative to the device housing.

The slot may be defined by a pair of moveable clamping members with oppositely facing surfaces for engaging the cable connector. The moveable clamping members may be configured to travel over a pair of guides connected to the base. To facilitate adjustment of the slot size and positioning of the clamping members with respect to the base, each clamping member may be provided with an aperture at opposite ends through which guides of varying length, slidably extend. A pair of locking elements may be provided to secure the cable connector within the slot and to lock the clamping members against further movement with respect to the base.

One advantage of the present invention is that it provides secure coupling between a cable connector and an associated terminal of an electrical device.

Another advantage of the present invention is that it may provide an adjustable slot for receiving cable connectors of varying size and shape.

Another advantage of the present invention is that it provides a moveable slot to secure a cable connector to terminals at a variety of positions within the electrical device.

BRIEF DESCRIPTION OF THE DRAWINGS

Other objects and advantages of the present invention will become apparent upon reading the following detailed description and upon reference to the accompanying drawings in which.

Figure 1:
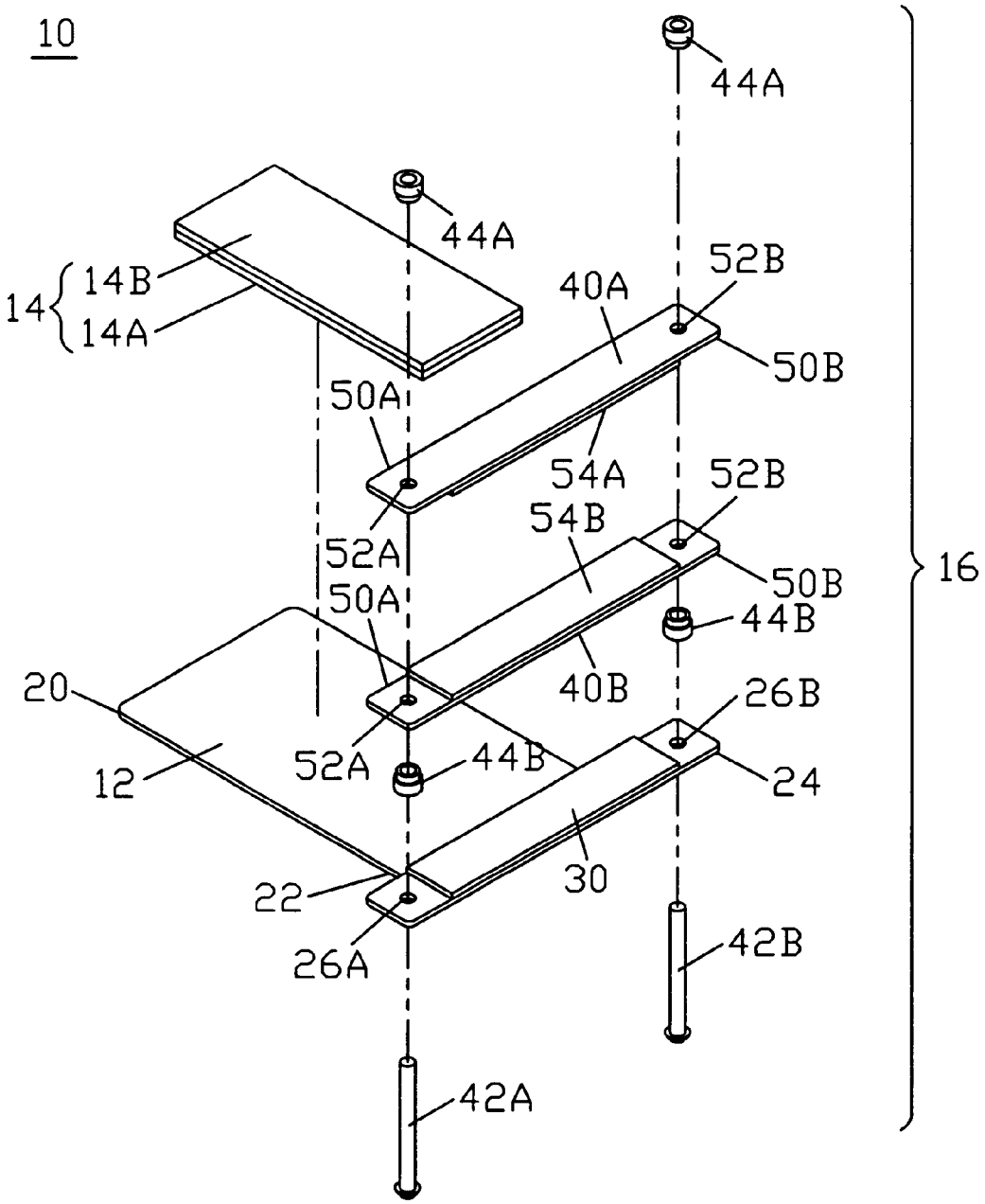
FIG. 1 is an exploded view of a strain relief device employing the present invention.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents, and alternatives falling within the spirit and scope of the present invention as defined by the appended claims.

DETAILED DESCRIPTION OF THE PREFERRED EMBODIMENTS

The description of the present invention will now be made with respect to FIGS. 1–5 which show various embodiments thereof. It is to be understood, however, that the present invention is not limited to the embodiments shown in FIGS. 1–5.

The present invention finds particular application in connection with portable computers, e.g. laptops, notebooks, or other electrical devices which transmit and receive data at an I/O terminal. For example, laptops include an I/O terminal slot configured to receive a PC card. The PC card connects via data cable to an external device and allows data communication therebetween. The laptop and PC card generally lack coupling hardware to secure a communication path between the laptop and external device. Often times, the PC card loosens or disconnects from the I/O terminal of the laptop computer during data collection in field experiments as mentioned above. FIG. 1 shows an exploded view of a strain relief device 10 employing the present invention. The strain relief device 10 includes a base 12, a fastener 14, and a clamping device 16.

Base 12 is a flat member preferably formed from anodized aluminum. Base 12, however, could be formed from an electrically insulating material such as plastic. Base 12 has a smooth surface extending between first and second end portions 20 and 22. A flat tab 24 is integrally connected to and extends from the second end portion 22. A pair of base apertures 26A and 28B are formed through opposite ends of tab 24. A strip of compressible material 30, such as foam rubber, is fixedly attached to an upper surface of tab 24.

Fastener 14 is connected to an upper surface of base 12 near first end portion 20. Fastener 14 is configured to releasably fasten base 12 to an external surface of an electrical device, e.g., a computer (see FIG. 3). Accordingly, fastener 14 is configured to releasably fasten strain relief device 10 to the external surface of the electrical device.

In one embodiment, fastener 14 includes a strip of hooks (not shown) connected to a strip of loops (not shown), wherein one of the strips, i.e. strip 14A, is glued to the upper surface of base 12 while the other strip, i.e. strip 14B, is glued to the external surface of the electrical device. The strips of hooks and loops, often referred to as Velcro™, allow the strain relief device 10 to be easily attached and detached from an associated electrical device.

In an alternative embodiment, fastener 14 may include a pair of strips each having a plurality of fingers (not shown) extending perpendicularly therefrom. Each of these fingers may include an enlarged end whereby the fingers of one strip releasably interlock with the fingers of the other strip. One of the strips is fixedly glued to the upper surface of base 12 while the corresponding strip is glued to the external surface of the electrical device. These strips, often called Dual-Lock™ industrial fasteners, allow the base 12, and thus the strain relief device 10, to be easily attached and detached from the electrical device housing.

Clamping device 16 includes, in one embodiment, a pair of clamping members 40A and 40B, clamping member guides 42A and 42B, and pairs of locking elements 44A and 44B. In one embodiment, guides 42A and 42B are defined as elongated screws with threaded shafts extending through base apertures 26A and 26B. In one embodiment, each elongated screw is fixedly connected to base 12. In another embodiment, the elongated screws can be removed from base 12 and replaced with screws of different length.

Locking elements 44A and 44B, in one embodiment, are defined by pairs of thumb nuts fitted to the diameter of and configured to interact with guides 42A and 42B. Locking elements 44A and 44B are mounted to guides 42A and 42B respectively, with clamping members 40A and 40B positioned therebetween. Rotation of the locking elements 44A and 44B as defined by thumb nuts, causes a lateral movement thereof over guides 42A and 42B for releasedly securing the clamping members 40A and 40B and a cable connector (not shown) positioned therebetween.

Clamping members 40A and 40B are moveable with respect to each other and individually with respect to base 12. In one embodiment, clamping members 40A and 40B are defined by longitudinally extending flat members extending between first and second ends 50A and 50B. Each clamping member 40A and 40B includes first and second apertures 52A and 52B extending through first and second ends 50A and 50B, respectively. Apertures 52A and 52B are spaced from each other and sized to fit guides 42A and 42B, respectively, to allow clamping members 40A and 40B to slidably travel over guides 42A and 42B.

Figure 4:
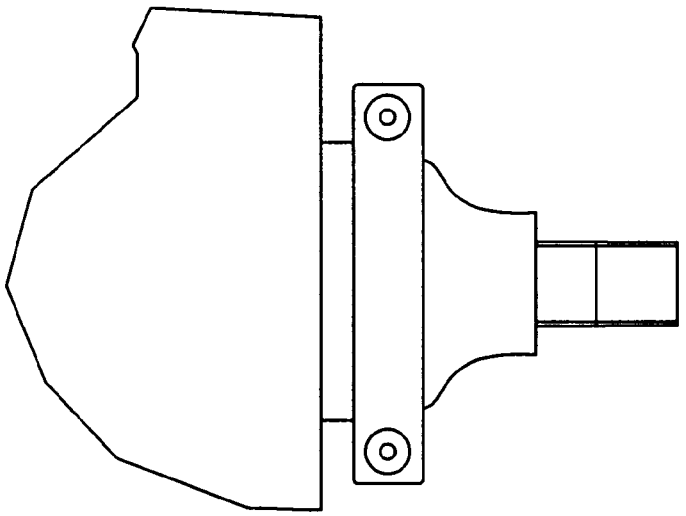
FIG. 4 is a top plan view of the strain relief device attached to the computer housing in FIG. 3.
Figure 5:
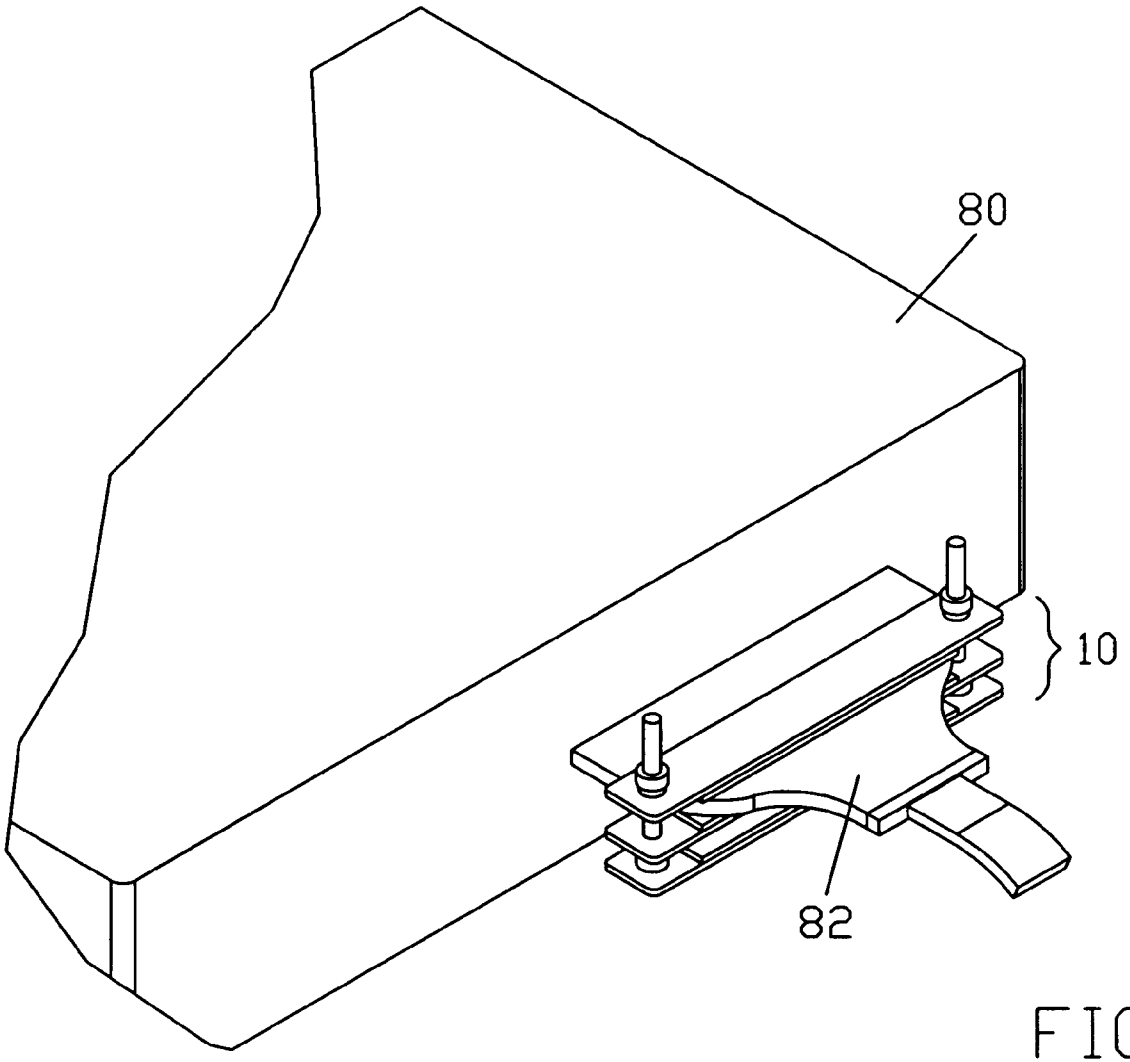
FIG. 5 is a perspective view of the strain relief device attached to the base of the computer shown in FIGS. 3 and 4.

Clamping members 40A and 40B are mounted on guides 42A and 42B in a parallel fashion to define a slot 60 (see FIG. 2A) therebetween. Clamping members 40A and 40B include oppositely facing surfaces with a strip of compressible material, such as foam rubber, configured in one embodiment for engaging a cable connector. The compressible strips 54A and B provide a non-slip gripping surface for engaging opposite sides of a cable connector received between clamping members 40A and 40B. FIGS. 4 and 5 show the strain relief device 10 of FIG. 1 assembled with a cable connector 66 received therebetween. Given that clamping members 40A and 40B are slidely moveable over guides 42A and 42B with respect to each other and base 12, slot 60 is adjustable in size to receive cable connectors of varying thickness or size at various elevations above base 12.

Figure 2A:
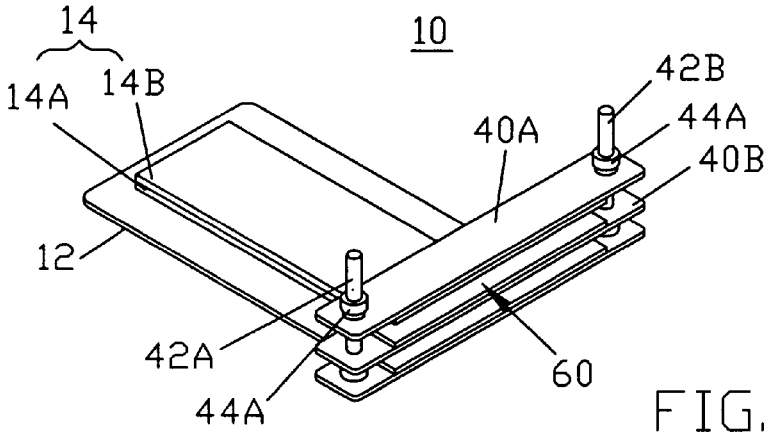
FIGS. 2A–2C are perspective views of a strain relief device embodying the present invention.
Figure 3:
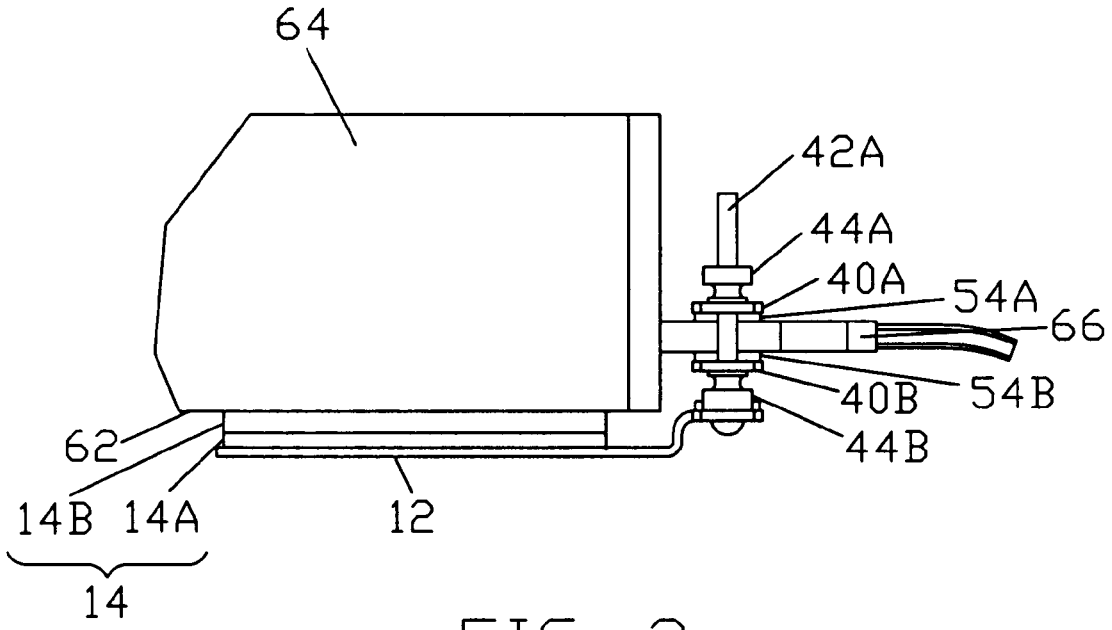
FIG. 3 is a side elevational view of the strain relief device shown in FIG. 2A as it is attached to a base surface of a computer housing.

FIG. 2A and 3 show an assembled version of the strain relief device shown in FIG. 1. FIG. 2A shows the strain relief device 10 with clamping members 40A and 40B defining slot 60 which is configured to receive the cable connector (not shown). FIG. 3 shows strain relief device 10 attached to a base surface 62 of an electrical device 64 such as a laptop computer. In FIG. 3, slot 60 receives cable connector 66 for secure coupling to a terminal (not shown) of electrical device 64. When locking elements 44A are rotated, locking elements 44A translate up or down guides 42A and B which in turn allows translation of clamping member 40A up and down guides 42A and 42B. It is to be noted that locking elements 44B may also be rotated to provide translation of locking elements 44B up and down guides 42A and 42B thereby allowing movement of clamping member 40B up and down guide 42A and 42B.

It is noted that a terminal (not shown) to which a cable connector is to be coupled, may be positioned in electrical device 64 at a variety of positions with respect to base surface 62. The present invention seeks to accommodate the difference in possible positions of the terminal by allowing slot 60 to adjust in elevation relative to base 12.

With the strain relief device securing cable connector 66 as shown in FIG. 3, coupling between cable connector 66 and the terminal (not shown) of device 64 is secured against disconnection caused by many types of external mechanical forces.

Figure 2B:
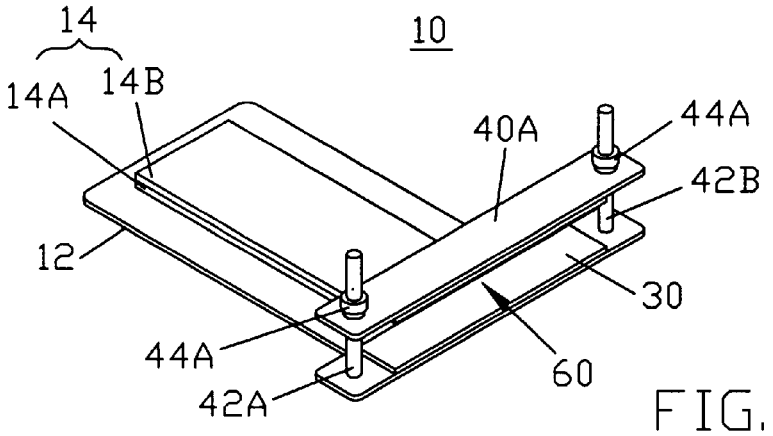
Figure 2C:
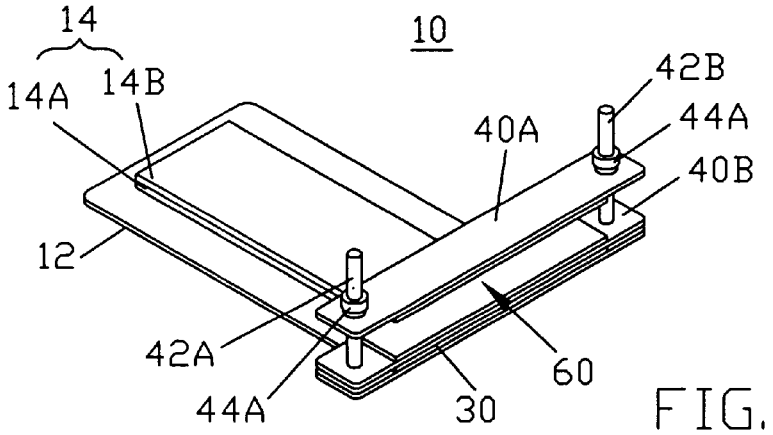

FIGS. 2B and 2C show alternative embodiments of the present invention. FIG. 2B shows the strain relief device of FIG. 2A without clamping member 40B and locking elements 44B. In this configuration, slot 60 is defined by compressible strip 30 on base 12 and clamping member 40A. In this configuration, only the size of slot 60 is adjustable.

FIG. 2C shows another embodiment of the present invention. FIG. 2B shows the strain relief device of FIG. 2A without locking elements 44B. In this configuration, clamping member 40B rests on the compressible strip of base 12. In this configuration, slot 60 can be positioned more closely to base 12.

In each of the embodiments shown in FIG. 2A–2C, once a cable connector (not shown) is inserted into slot 60, locking elements 44A and/or 44B are translated along guides 42A and 42B until the cable connector (not shown) is secured within slot 60.

FIG. 5 shows a laptop 80 computer with a PC card and cable 82 securely connected thereto using the strain relief device 10 of the present invention. As mentioned earlier, neither PC cards nor laptops include coupling hardware to guard against PC cards decoupling from laptops. Using the strain relief device 10 of the present invention, PC cards, such as that shown in FIG. 5, are more securely connected to the I/O slots.

Various alterations, improvements, and modifications will occur and are intended to those skilled in the art, though not expressedly stated herein. These modifications, alterations, and improvements are intended to be suggested hereby, and are within the spirit and scope of the invention. Accordingly, the invention is limited only by the following claims and equivalents thereto.

What is claimed is:

1. An apparatus for securing attachment of a cable connector to a data terminal of an electrical device, comprising:

a base;

a tab extending from a first end of the base, wherein the tab includes a first aperture and a second aperture;

a fastener comprising a first strip and a second strip, wherein the first strip includes a first surface and a second surface, wherein the first surface of the first strip is configured for attachment to an external surface of the electrical device, wherein the second strip includes a third surface and a fourth surface, wherein the fourth surface of the second strip is configured for attachment to the base, wherein the second surface of the first strip is configured for releasable fastening to the third surface of the second strip;

a first clamping guide and a second clamping guide, wherein the first clamping guide extends through the first aperture, and the second clamping guide extends through the second aperture;

a first clamping member which includes a third aperture and a fourth aperture, wherein the first clamping guide also extends through the third aperture, and the second clamping guide also extends through the fourth aperture;

a first pair of locking elements which determine a first position for the first clamping member along a first axis defined by the first clamping guide;

a second clamping member which includes a fifth aperture and a sixth aperture, wherein the first clamping guide also extends through the fifth aperture, and the second clamping guide also extends through the sixth aperture;

a second pair of locking elements which determine a second position for the second clamping member along the first axis;

wherein the first pair of locking elements and the second pair of locking elements are independently adjustable to control the first position of the first clamping member and the second position of the second clamping member respectively along the first axis.

2. The apparatus of claim 1, wherein a space between the first clamping member, the second clamping member defines a slot for admission of the cable connector.

3. The apparatus of claim 2, wherein the first locking elements and second locking elements are adjusted so that the first clamping member and second clamping member (a) apply pressure to the cable connector positioned within the slot, and (b) hold the cable connector in a fixed position relative to the electrical device.

4. The apparatus of claim 1, wherein the first surface of the first strip is configured for gluing to the external surface of the electrical device.

5. The apparatus of claim 1, wherein the fourth surface of the second strip is configured for gluing to the base.

6. The apparatus of claim 1, wherein the electrical device is a computer.

7. The apparatus of claim 1, wherein the first pair of locking elements comprise a first pair of thumb nuts, and wherein the first clamping guide and the second clamping guide comprise elongated screws.

8. The apparatus of claim 1, wherein the first clamping guide and second clamping guide extend perpendicularly to the tab.

9. The apparatus of claim 1, wherein a first inner surface of the first clamping member is configured with a third strip of compressible material for non-slip gripping of the cable connector, wherein the first inner surface faces towards the slot.

10. The apparatus of claim 1, wherein a second inner surface of the second clamping member is configured with a fourth strip of compressible material for non-slip gripping of the cable connector, wherein the second inner surface faces towards the slot.

11. The apparatus of claim 1, wherein the first pair of locking elements include a first locking element mounted to the first clamping guide and a second locking element mounted to the second clamping guide, wherein the first pair of locking elements are positioned adjacently to the first clamping member.

12. The apparatus of claim 11, wherein the second pair of locking elements include a third locking element mounted to the first clamping guide and a fourth locking element mounted to the second clamping guide, wherein the second pair of locking elements are positioned adjacently to the second clamping member.

13. The apparatus of claim 12, wherein the first clamping member and second clamping member are positioned along the first axis between the first pair of locking elements and the second pair of locking elements, and wherein the first clamping member is positioned closer to the tab than the second clamping member.

14. The apparatus of claim 13, wherein the first pair of locking elements are removed from the first and second clamping guides to allow the first clamping member to rest against the tab so that the slot may approach closely to the tab.

15. The apparatus of claim 13, wherein the first pair of locking elements and first clamping member are removed from the first and second clamping guides, wherein the cable connector is admitted into the spatial region between the tab and the second clamping member.

16. The apparatus of claim 15, wherein a fifth surface of the tab is configured with a compressible material for non-slip gripping of the cable connector.

17. The apparatus of claim 1, wherein the fastener comprises a VELCRO™ fastener.

18. The apparatus of claim 1, wherein the fastener comprises a Dual-Lock™ fastener.

19. A strain relief device comprising:

a base;

a fastener configured for releasably fastening the base to an external surface of an electrical device;

a first clamping guide and a second clamping guide, wherein the first clamping guide and second clamping guide extend perpendicularly from the base;

a first clamping member attached to the first clamping guide and the second clamping guide;

a second clamping member also attached to the first clamping guide and the second clamping guide;

wherein a first pair of locking elements determine a position of the first clamping member along an axis defined by the first and second clamping guides, wherein a second pair of locking elements determine a second position of the second clamping member along the axis, wherein the first clamping member and the second clamping member define a slot, said slot having an adjustable size and elevation when said second pair of locking members are moved along the axis for admission and secure holding of a cable connector.

20. A system comprising:

a computer;

a cable connector;

a strain relief apparatus for securing attachment of the cable connector to the computer, wherein the strain relief apparatus comprises:

a base configured for releasable fastening to an external surface of the computer;

a pair of clamping guides extending perpendicularly from the base;

a first clamping member attached to the pair of clamping guides;

a second clamping member attached to the pair of clamping guides;

wherein a first pair of locking elements are adjustable to determine a first position of the first clamping member along an axis defined by the pair of clamping guides, wherein a second pair of locking elements are adjustable to determine a second position of the second clamping member along the axis, wherein the first clamping member and the second clamping member define a slot, said slot having an adjustable size and elevation when said first pair of locking members are moved along the axis for admission and secure holding of the cable connector with respect to the computer.

21. The system of claim 20, wherein the computer is a laptop computer.

22. The system of claim 20, wherein the cable connector is a Personal Computer (PC) card.

* * * * *